US005457854A

United States Patent [19]

Easom

[11] Patent Number: 5,457,854

[45] Date of Patent: Oct. 17, 1995

[54] DRAW-CORD AND METHODS OF INCORPORATING IT WITHIN A TUNNEL OF FABRIC

[75] Inventor: Peter W. Easom, Melton Mownray, United Kingdom

[73] Assignee: Automatic Braiding Limited, Leicestershire, United Kingdom

[21] Appl. No.: 162,033

[22] PCT Filed: Jun. 10, 1992

[86] PCT No.: PCT/GB92/01032

§ 371 Date: Dec. 2, 1993

§ 102(e) Date: Dec. 2, 1993

[87] PCT Pub. No.: WO92/22696

PCT Pub. Date: Dec. 23, 1992

[30] Foreign Application Priority Data

Jun. 14, 1991 [GB] United Kingdom ..... 9112908

[51] Int. Cl.[6] ..... A41F 9/00; D04D 9/00

[52] U.S. Cl. ..... 24/300; 24/712; 2/237

[58] Field of Search ..... 24/712, 712.3, 24/712.2, 715.3, 715.4, 300, 371; 2/237

[56] References Cited

U.S. PATENT DOCUMENTS

| | | | |
|---|---|---|---|
| 2,721,331 | 10/1955 | Scheitlin | 2/237 |
| 2,751,599 | 6/1956 | Peterson | 2/237 |
| 2,854,670 | 10/1958 | Naccash | 2/237 |
| 3,559,213 | 2/1971 | Goodman | 2/237 |
| 3,581,353 | 6/1971 | Sonntag | 24/715.4 |
| 3,887,968 | 6/1975 | Lynam | 24/712 |
| 4,694,541 | 9/1987 | Skyba | 24/300 |

FOREIGN PATENT DOCUMENTS

| | | |
|---|---|---|
| 1000957 | 6/1957 | Germany . |
| 1385296 | 2/1975 | United Kingdom . |
| 1406821 | 9/1975 | United Kingdom . |
| 2124890 | 2/1984 | United Kingdom . |
| 8600789 | 2/1986 | WIPO . |

*Primary Examiner*—Victor N. Sakran
*Attorney, Agent, or Firm*—Lorusso & Loud

[57] ABSTRACT

A draw-cord assembly comprises a draw-out which is extensible from a retracted condition to an extended condition and restraining means, secured in the cord. The cord and restraining means are such that the cord is retained in its retracted condition by the restraining means until the means is rendered ineffective, whereupon the cord is permanently extended from its retracted condition. The restraining means retain the cord in its retracted condition provided that the lengthwise load exceeding a certain minimum load is not exceeded, but extended by application of a greater load.

9 Claims, 4 Drawing Sheets

DRAW-CORD AND METHODS OF INCORPORATING IT WITHIN A TUNNEL OF FABRIC

This invention relates to a draw-cord and to methods of incorporating it within a tunnel of flexible sheet material.

Draw-cords are found in many situations, for example around openings defining the wearer-encircling portions of many garments such as activewear, sports shorts, swimming trunks, leisure trousers, pyjamas, pullovers, anoraks and the like, and in providing means for closing the neck region of bags eg. shoe bags. Such cords may be extensible or substantially non-extensible and, for use in garments are commonly knitted, woven, braided or knit-braided construction. The incorporation of draw-cords by known manufacturing methods in a particular garment requires that the draw-cord be longer than the wearer-encircling portion in normal circumstances, so that in use the opposite ends of the draw-cord can be tied together or, where the ends of the cord are secured e.g. in a waist-band seam, a loop of cord can be pulled through a hole in a waist-band region and knotted. In one known method of incorporating a draw-cord in a hem tunnel around a garment opening, the hem tunnel is first formed and the draw-cord thereafter threaded into the pre-formed tunnel, allowing introduction of the extra length of draw-cord required in relation to the fabric; this process is somewhat cumbersome because it requires the threading of the draw-cord into the pre-formed hem tunnel.

Draw-cords provided within an elastic band which is to be attached to a fabric (so-called "draw-cord elastic") are also known and used extensively, for example as disclosed in GB 1406821. Whilst such cord assemblies are convenient from the point of insertion, and permit both draw-cord and elastic to be incorporated simultaneously as the hem tunnel is formed, relatively large stock-holding of draw-cord elastic may be needed in view of the need to change the type of elastic draw-cord to suit the current fashion trends. Furthermore, this method of insertion only permits insertion of a length of draw-cord which is dependent on the extension of the associated elastic band. For example the elastic band could be made at 160% extension and would include an equal length of draw-cord in its extended state, i.e. in its manufactured fully extended state the elastic could, for example, be 260 cm long and would include 260 cm of draw-cord; relaxed the elastic would be 100 cm long but still containing 260 cm of cord which could be drawn out. Inserted in a waist-band, partially extended, the fully extended waist-band length could be 180 cm, having an excess 80 cm of draw-cord. The excess length of draw-cord is thus fixed at manufacture.

In one aspect the invention may be considered to provide a draw-cord assembly comprising a draw-cord which is extensible from a retracted condition to an extended condition, in combination with restraining means comprising a substantially inextensible core within the cord adapted to maintain the said draw-cord temporarily in its retracted condition until the restraining means is rendered ineffective thus permitting the extension of the draw-cord.

In another aspect the invention may be considered to provide a method of assembling a draw-cord with a piece of flexible sheet material, said method comprising the steps of progressively feeding the sheet material and a draw-cord in accordance with the invention in its retracted condition into operating instrumentalities at the same rate, said operating instrumentalities forming a hem tunnel on the sheet material with the draw-cord therein, and thereafter rendering the restraining means ineffective thus permitting the draw-cord to be permanently extended from its retracted condition.

Although the restraining means may be rendered ineffective immediately after incorporation of the draw-cord in the hem tunnel, this step may be delayed until later in the garment making operation, if desired.

Various embodiments of the invention will now be described with reference to the following drawings, to illustrate the invention by way of example.

Figure 7A:
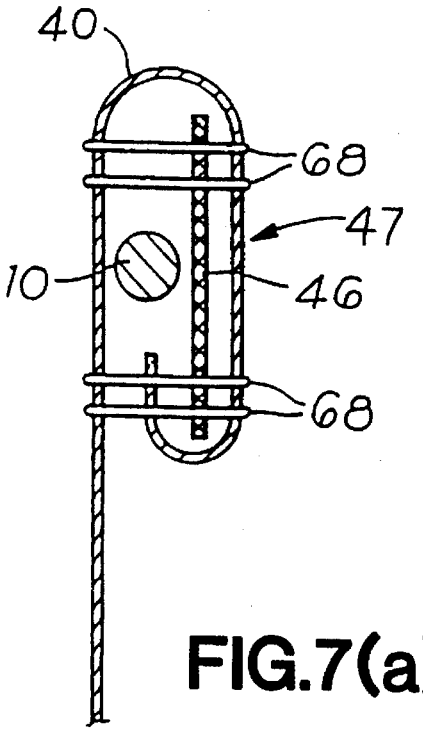
Figure 7B:
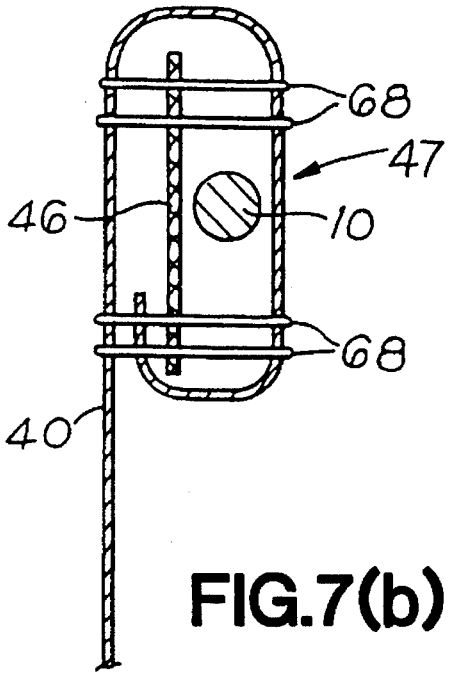
Figure 8A:
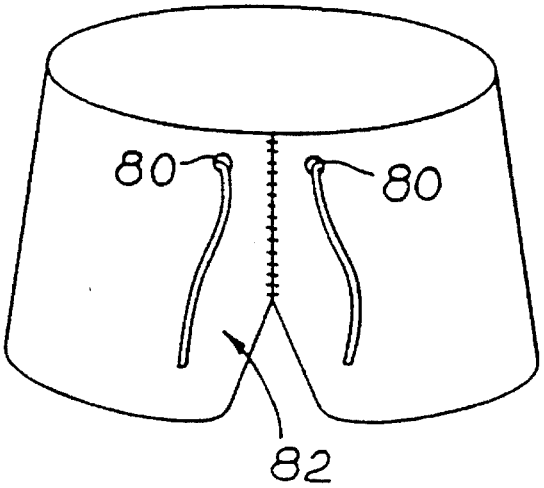
Figures 1, 8B:
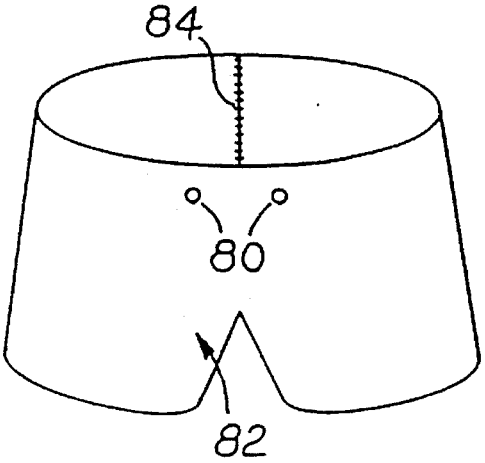
Figures 1, 8C:
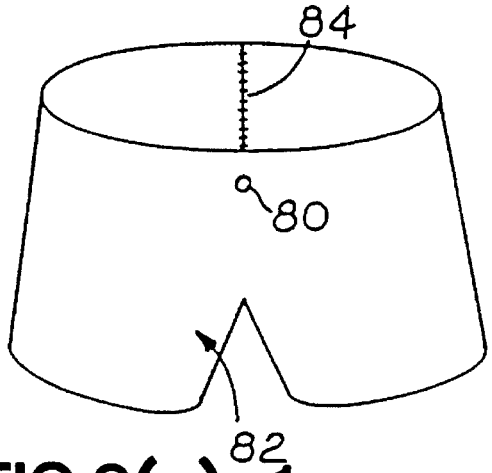
Figures 2, 8B:
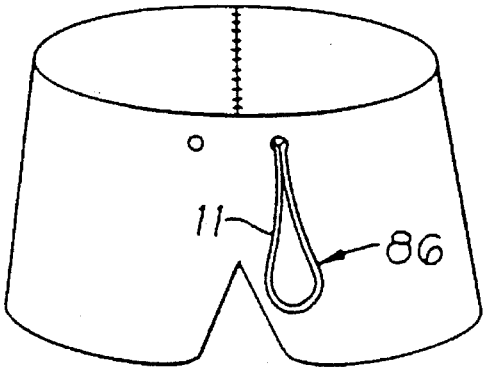
Figures 2, 8C:
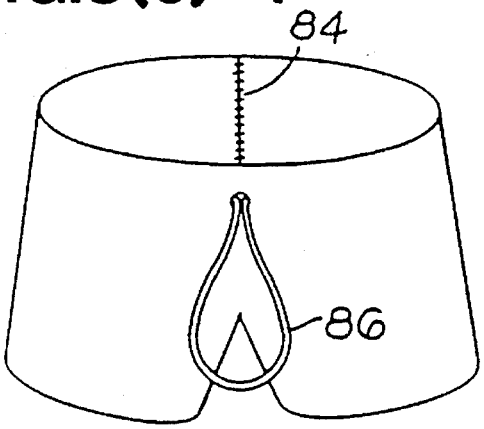
Figures 3, 8B:
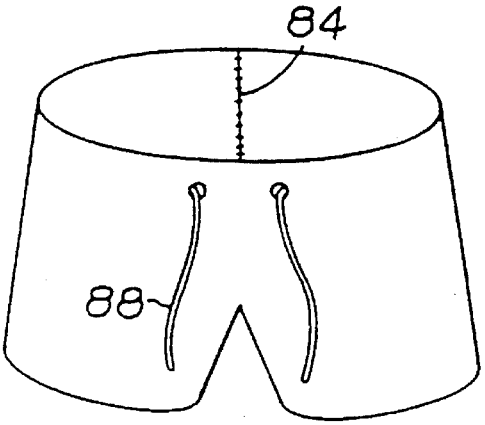
Figure 9:
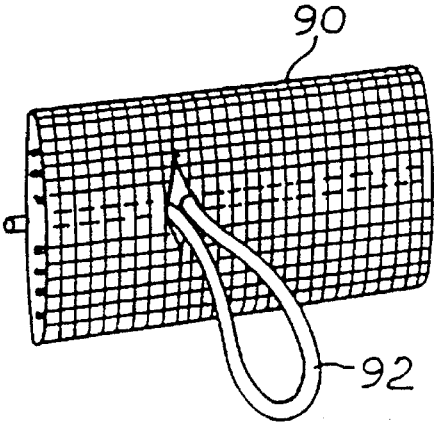

FIGS. 7(*a*) and 7(*b*) are end views of a finished hem;

FIGS. 8(*a*)–8(*c*) are diagrammatic views showing the incorporation of a draw-cord assembly embodying the invention in a garment waist-band; and FIG. 9 is a diagrammatic view showing a further method of using a draw-cord embodying the invention.

In the manufacture of the first illustrative draw cord assembly 10, a draw-cord 11 is produced by a known knit braiding technique, for example using a Fast-Knit Braider M.C.2 made by Valentin Rius Clapers S.A. The draw-cord 11 is produced in this machine in tubular form by a knitting technique. A substantially non-extensible core filament 12, (e.g. a non-extensible polyester mono-filament or multi-filament or other non-extensible core, e.g. of polypropylene), is fed into the central opening of the cord 11 during manufacture. The leading ends of the cord 11 and filament 12 are secured together by any suitable means 14, for example by a locking knot, by a heat-sealing technique or merely by clamping the ends to a take-up reel onto which the knitted cord/filament assembly is wound during manufacture.

The filament 12 may be of a heat-shrink plastics material which contracts when subjected to an elevated temperature. In this case leading and trailing ends of the cord 11 and filament 12 are likewise secured together but the assembly is subjected to heat causing the filament 12 to retract thus consolidating the cord 11 to a more tightly configured retracted condition. The assembly may pass through a heated oven during production to cause shrinkage of the filament as the assembly is produced, or be produced in loose lengths, each length heated as a whole in an oven, subsequently being wound onto reels for supply to the consumer.

In some cases, using a core filament 12 of suitable material the heating may be such as to cause the filament to soften after contracting and to then bond lightly to the cord 11, thus acting as the restraining means after cooling: this may make subsequent use more convenient.

Similar techniques using heat-shrinkable filaments may be used by knitting a heat-shrinkable filament substantially lengthwise of the cord 11 into the fabric of the cord 11 during production or, in production of a braided cord, a similar lengthwise heat-shrinkable filament may be incorporated.

Figure 1:
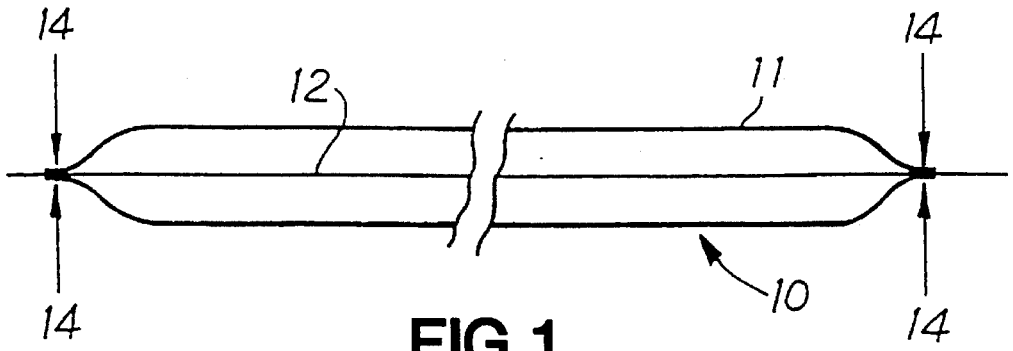
FIG. 1 is a diagrammatic view of a first draw-cord assembly embodying the invention.
Figure 2:
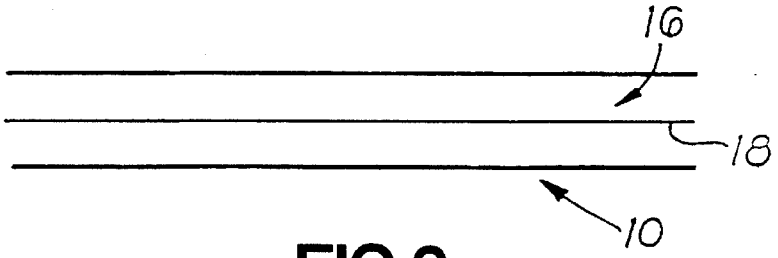
FIG. 2 is a diagrammatic view of a second draw-cord assembly embodying the invention.

In some cases (see FIG. 2) where a filament is included as a core to a tubular knit-braided cord 16 there may be sufficient frictional engagement between consolidated cord and filament 18 such that the cord 16 and filament 18 do not slide relative to one another, tensioning forces greater than a pre-selected minimum overcoming the frictional forces and/or breaking the filament 18, permitting extension of the cord 16 from its retracted condition.

In manufacture of a draw-cord assembly embodying the invention, the draw-cord, in its retracted condition, may be consolidated in length by 33% for example, in which case an extension of 50% from retracted to fully extended length arises; in some circumstances, substantially greater extension may be required.

In all cases a cord, according to the invention, is maintained by the restraining means in its retracted condition substantially inextensibly, provided that a preselected lengthwise minimum load is not exceeded. This allows the cord assembly to be drawn from and fed by the machines under light tension and handled whilst the cord is still retained in its retracted condition. However, should the cord assembly be subjected to a tension greater than the preselected minimum load, or should the restraining means be released (as would be the case were the first illustrative cord to be cut), the cord may be permanently extended from its retracted condition, to an extended condition. A fully-extended condition is determined by the manufacturing techniques employed; however, the cord may relax from that to an intermediate condition but cannot return to its retracted condition (at least without external assistance).

This property of the illustrative cord assembly allows the illustrative cords to be fed around fabric openings, under a feed tension less than the preselected minimum load eg. during incorporation into a hem tunnel, the length of the fed cord in its retracted condition and of the fed fabric being the same. When the restraining means is rendered ineffective eg. by excess tension exceeding the minimum load or cutting the cord assembly, the cord is permanently extended from its retracted condition thereby providing a permanent excess length of draw-cord by comparison with the fabric length with which the cord is associated.

In order to secure a draw-cord assembly 10 embodying the invention within a hem tunnel around an opening in a flexible sheet material eg. the wearer-encircling portion of a garment, it is necessary to feed the consolidated cord assembly 10 in its retracted condition and attached to the garment or other fabric in such a way that relative sliding movement between garment fabric and cord is possible. The garment fabric and the cord are fed, for assembling purposes at the same feed rate.

In a preferred method of enclosing a cord assembly 10 embodying the invention use is conveniently made of a hem-forming machine 41 such as that described in detail in patent specification GB 2229199 or GB 1406821, for example as supplied by Automatic Braiding Limited as their Flexmatic Spiral Guide System.

Figure 4:
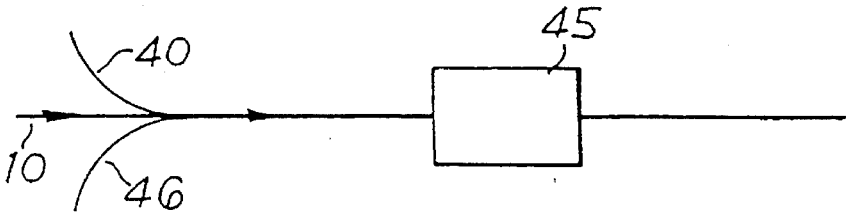
FIG. 4 is a schematic view of another method of attaching an illustrative draw-cord to a piece of fabric.

In order to incorporate a cord assemble 10 embodying the invention into the wearer-encircling portions of a garment without including an elasticated band, lengths of the fabric 40, and cord assembly 10 in its retracted condition are fed into a slightly modified spiral guide system (as mentioned above) at the same rate, such that the cord assembly 10 is sandwiched between the fabric 40 and the elastic band 46. FIG. 4 shows a schematic view of one arrangement.

Figure 5:
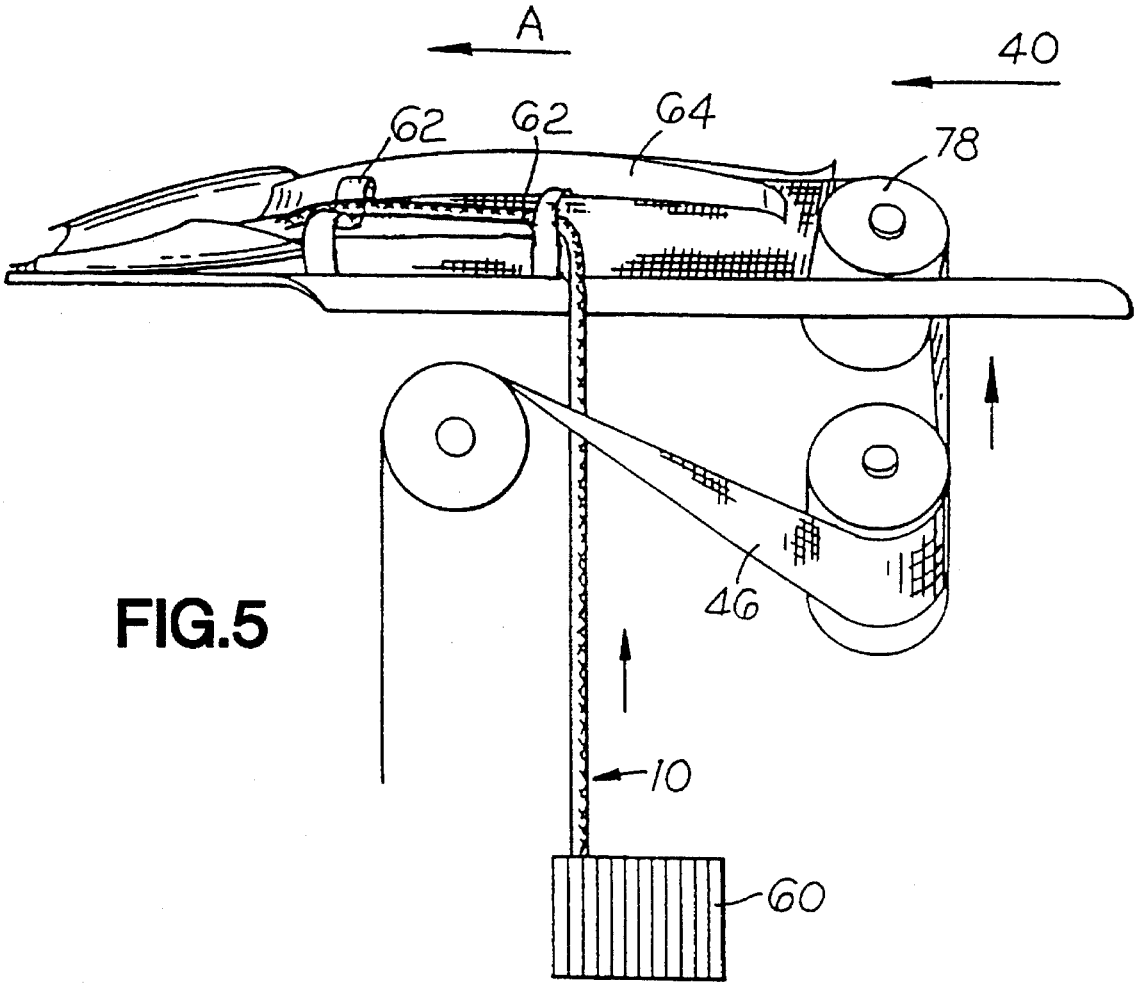
FIG. 5 is a schematic view of apparatus for feeding the cord, an elastic band and the fabric.
Figure 6:
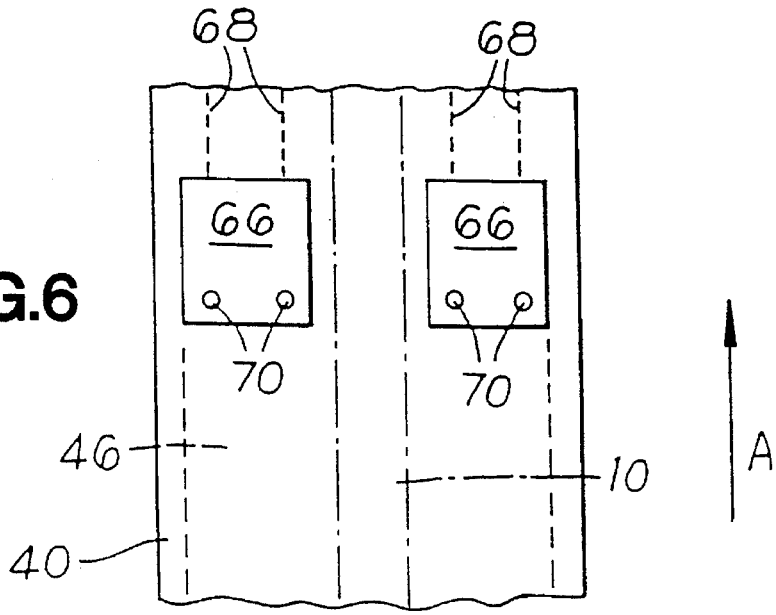
FIG. 6 shows a schematic plan view of a stitching process.

FIG. 5 shows a possible feeding arrangement where fabric 40 (not shown in FIG. 5 for clarity), the cord assembly 10 and an elastic band 46 are used. The cord assembly 10 (as indicated by the arrows) is fed from a reel 60 and provided such that the internal filament 12 is unable to move relative to the cord 11 as previously described. The cord assembly 10 is drawn around a guide means 62 (which in the case of FIG. 5 are provided by grooved portions of brackets supporting parts of the folding instrumentalities) under a small tension such that it is disposed at a desired position, for example centrally, with respect to the elastic 46. The elastic 46 is also supplied from a box (not shown), under a desired tension, extended by a controlled amount, in a known manner to a spiral folder 64. The fabric 40, draw-cord assembly 10 and elastic 46 (under tension) are fed (see FIG. 4) at the same feed rate through the operating instrumentalities 45 eg. folding and sewing instrumentalities, in a manner familiar to the man skilled in the art, so that fabric is folded by the folder, thus being wrapped around the cord assembly 10 and the elastic 46, the fabric 40 forming a hem tunnel 47 (see FIG. 7), thereby enclosing the cord assembly 10. The folded fabric 40 is then stitched appropriately as shown in FIG. 6. In this particular embodiment four stitch lines 68 are formed using a sewing foot 66 grooved at a suitable position to accommodate the cord assembly 10 and with two pairs of needles 70 one at either side of the groove. Alternatively two spaced pairs of sewing feet 66 may be used. The cord assembly 10 is thus entrained in the gap between and parallel to, the inner two stitch lines 68. The fabric 40, elastic 46, and cord assembly 10 viz. cord 16 and hence filament 18 are then cut, leaving a length of fabric, an equal length of elastic and an equal length of consolidated cord, and hence filament, disposed therebetween. FIG. 7(*a*) shows a cross-sectional view of the completed hem tunnel incorporating the draw-cord assembly 10. After the cord assembly 10 has been entrained in a desired length hem-tunnel, the garment leaves the rollers 42 and the elastic band 46 relaxes from its extended condition to a relaxed condition causing ruching of the fabric. The fabric 40, cord 10 and hence the enclosed filament 12 may then be cut by cutters 44 just downstream of the rollers 42, or alternatively the garment fabric may be removed from the machine still connected by lengths of elastic and draw-cord to be separated by scissors at the next processing stage or at the machine on completion of a batch. In any event, there is formed a garment fabric with a hem-tunnel, in which is positioned a cord 11 which, in its retracted condition, is of length substantially equal to the extended length of the garment fabric lengthwise of the hem tunnel. It is to be noted that the action for cutting between garments would render the restraining means ineffective where this is provided by a filament 12. Alternatively, the cord assembly 10 can be then pulled at both ends applying a load (greater than a preselected minimum load) sufficient to break the filament 12 (or 18), thus overcoming the restraining means and permitting extension from its retracted condition to an extended state. The garments can be further processed by a variety of different methods, some of which are outlined below with reference to FIGS. 8(*a*), 8(*b*) and 8(*c*).

In the method of FIG. 8(*a*) the cord is pulled out of preformed "button" holes 80 approximately 25 mm from each end of the garment waist-band before the garment is seamed up at the front 82.

In the second method (FIG. 8(*b*)) the garment is first seamed at the rear securing both free ends of the draw-cord (and elastic if present) in the seam 84 (FIG. 8(*b*)(i)). A loop 86 of the draw-cord 11 is pulled through one of the two "button" holes 80 in the front 82 of the garment (FIG. 8(*b*)(ii)) and one end 88 of the cut cord is pulled through the other button hole 80.

In the third method (FIG. 8(*c*)) the garment is seamed at the rear, as in the second methods securing both free ends of draw-cord and elastic (if present) in the seam 84 (FIG. 8(*c*)(i). In this instance there is a single "button" hole 80 at the front 82 through which a loop 86 of draw-cord 11 is pulled.

In methods otherwise similar to any of these methods the button holes and cord can be on the inside of the garment. In order to achieve this, the path of the cord would be altered eg. to pass round the roller 78 outwardly of the elastic 46.

After the cord assembly has been cut in separating the garments, at an appropriate stage in manufacture, the cord assembly 10 may be pulled to overcome the restraining means to cause the cord 11 to extend from its retracted condition. However, once the cord 11 has been permanently extended from its retracted condition (by rendering the restraining means, ineffective) the cord length permanently exceeds the fully-extended length of the fabric around the garment opening with which the cord is associated.

Whereas, as described with reference to FIG. 7(*a*), the cord assembly 10 is enclosed within a hem tunnel, the cord assembly 10 may (by choosing an appropriate feeding point in the spiral guide apparatus) be incorporated into the hem tunnel at the opposite side of the elastic band 46 (see FIG. 7(*b*)). In yet another method the cord assembly 10 may merely be sandwiched between the main body of flexible sheet material and another layer of flexible material eg. woven, inextensible tape or an elastic band, to retain it in place.

The illustrative method permits a draw-cord having an effective length, in subsequent use, greater than that of the extended length of the hem tunnel in which the draw-cord is enclosed, to be readily incorporated in a hem tunnel, whether or not in association with an elastic band.

Figure 3:
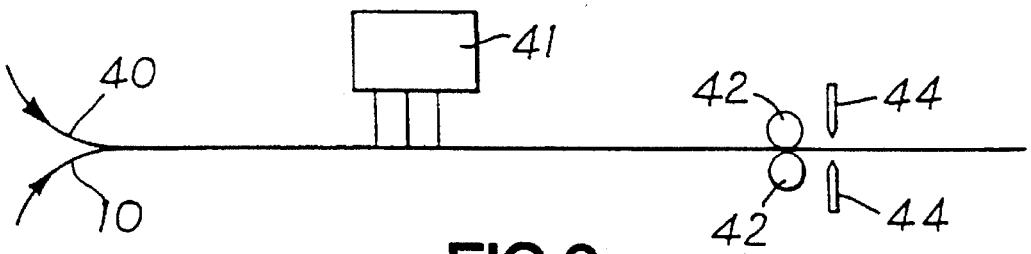
FIG. 3 is a schematic view of a method of attaching an illustrative draw-cord to a piece of fabric.

In a further method (see FIG. 9) the cord could be incorporated into a hem tunnel at one side of an elastic band 90 of special construction having elastic strands and warp stitches missing; this allows a cord loop 92 to be pulled through appropriately positioned holes in the elastic. Furthermore, it is also possible to incorporate a cord assembly embodying the invention into a hem tunnel without any other sheet material, e.g. an elastic band (FIG. 3).

In all cases it is important that the majority of the cord is slidable relative to the main body of flexible sheet material, though in some cases they may be secured together at one point eg. by stitching as hereinbefore described, merely to maintain the cord in a required relation to the sheet material.

Where an elastic band is also to be incorporated, draw-cord and elastic may be selected from a relatively limited supply according to the required use. Thus instead of keeping in stock a number of eg twelve different draw-cord elastics, with the present invention stocks of a number of draw-cords according to the invention must be kept but only one type of elastic. This is clearly cheaper in stock costs. Where special draw-cord colours or styles are needed, using known draw-cord elastic, the cord must be dyed and the draw-cord elastic manufactured. With a cord in accordance with the invention, it is only necessary to supply the dyed cord, the step of manufacturing the special elastic being eliminated, thus offering a faster service.

Draw-cord in accordance with the invention may be incorporated with elastic around garment openings wherein the elastic has regions of differing elasticity or so-called intermittent elastication.

Draw-cord for use in draw-cord assemblies in accordance with the invention may be manufactured by knitting, knit-braiding, braiding, weaving, stitching or any other means of providing a restrained cord construction.

I claim:

1. A draw-cord assembly comprising a draw cord which is extensible from a retracted condition to a permanently extended condition, in combination with restraining means comprising a substantially inextensible core within the cord which maintains said draw cord temporarily in its retracted condition until the restraining means is rendered ineffective thus permitting permanent extension of the draw-cord.

2. A draw-cord assembly according to claim 1 wherein the restraining means is adapted to retain the draw-cord in its retracted condition with little or no extension when the draw-cord is subjected to loads less than a pre-selected minimum load but to yield when the draw-cord is subjected to a load greater than said minimum load, permitting ready extension, permanently from its retracted condition.

3. A cord assembly according to claim 1 wherein the cord is of tubular construction and the restraining means comprises a substantially inextensible cord of length equal to that of the cord in its retracted condition disposed within a central void of the cord.

4. A method of making a draw-cord assembly according to claim 3 wherein a filament is included as a core to a tubular knit-braided cord in frictional engagement with the filament such that the core and cord do not slide relative to one another, tensioning forces greater than a pre-selected minimum overcoming the frictional forces and/or breaking the filament thereby permitting extension of the cord from its retracted condition.

5. A cord assembly according to claim 1 wherein the core is a substantially inextensible mono-filament or multi-filament thread.

6. A method of making a draw-cord assembly according to claim 4 wherein the filament or each filament is of heat shrinkable material, comprising the steps of securing portions of the cord to the filament while the cord is in an extended condition and before the filament is shrunk; and thereafter shrinking the filament thereby consolidating the cord to its consolidated position.

7. A method of incorporating a draw-cord with a piece of flexible sheet material, said method comprising the steps of progressively feeding the sheet material and a draw-cord assembly according to claim 1, in its retracted condition into operating instrumentalities at the same rate, said operating instrumentalities forming a hem tunnel with the sheet material with the draw-cord assembly therein and thereafter rendering the restraining means ineffective, permitting the draw-cord to be permanently extended from its retracted condition.

8. A method according to claim 6 wherein the draw-cord is permanently extended from its retracted condition by application of a load in excess of a preselected minimum load.

9. A method according to claim 6 wherein an elastic band under tension, extended by a controlled amount is also enclosed in the hem tunnel with the draw cord-assembly as the hem tunnel is formed by said operating instrumentalities.

* * * * *